US008418313B1

(12) United States Patent
Miner et al.

(10) Patent No.: US 8,418,313 B1
(45) Date of Patent: Apr. 16, 2013

(54) POWER CORD PROTECTION SYSTEM FOR A FLOOR CLEANER

(76) Inventors: Jonathan L. Miner, Rockford, MI (US); Daniel R. Jaglowski, Grand Rapids, MI (US)

( * ) Notice: Subject to any disclaimer, the term of this patent is extended or adjusted under 35 U.S.C. 154(b) by 66 days.

(21) Appl. No.: 12/973,348

(22) Filed: Dec. 20, 2010

Related U.S. Application Data

(60) Provisional application No. 61/289,292, filed on Dec. 22, 2009.

(51) Int. Cl.
*A47L 9/02* (2006.01)

(52) U.S. Cl.
USPC ..... 15/344; 15/325; 15/422

(58) Field of Classification Search ..... 15/325, 15/378, 422; *A47L 9/02*
See application file for complete search history.

(56) References Cited

U.S. PATENT DOCUMENTS

| | | | |
|---|---|---|---|
| 1,254,396 | A | 1/1918 | Dance |
| 1,903,793 | A | 4/1933 | Richardson et al. |
| 3,646,629 | A | 3/1972 | Bienek |
| 3,733,640 | A | 5/1973 | Finberg et al. |
| 4,802,254 | A | 2/1989 | Lahndorff et al. |
| 6,553,599 | B2 | 4/2003 | Paterson et al. |

FOREIGN PATENT DOCUMENTS

| | | | |
|---|---|---|---|
| JP | 2224629 | A | 9/1990 |

*Primary Examiner* — David Redding
(74) *Attorney, Agent, or Firm* — McGarry Bair PC

(57) ABSTRACT

A vacuum cleaner comprises a housing adapted to move along a surface to be cleaned and having a suction nozzle at a forward portion thereof, at least one agitator mounted for rotational movement within the suction nozzle and at least one ground-engaging wheel mounted rearwardly of the suction nozzle and a cord guard mounted to the housing in a position rearward of the suction nozzle and adapted to block the ingestion into the suction nozzle of a cord on the surface to be cleaned during rearward movement of the base along the surface.

19 Claims, 11 Drawing Sheets

POWER CORD PROTECTION SYSTEM FOR A FLOOR CLEANER

CROSS-REFERENCE TO RELATED APPLICATIONS

This application claims priority to U.S. Patent Application No. 61/289,292, filed Dec. 22, 2009, which is incorporated herein by reference in its entirety.

BACKGROUND OF THE INVENTION

1. Field of the Invention

This invention relates to a floor cleaner. In one of its aspects, the invention relates to a an electrical floor cleaner with a power cord and a protection system for the power cord to minimize power cord abrasion.

2. Related Art

U.S. Pat. No. 6,553,599 to Paterson et al. discloses a vacuum cleaner with an anti-ingestion bar fixedly anchored beneath a base assembly and having side arms that are configured to span a rotatably-driven brush in the suction nozzle opening. The anti-ingestion bar prevents large debris (including a power cord) from becoming entangled with the brush or entering and clogging the inlet.

U.S. Pat. No. 4,802,254 to Lahndorff et al. discloses an anti-cord swallowing system for a vacuum cleaner comprising grooves around the periphery of a brush dowel that are aligned with and receive corresponding ribs that protrude from within the nozzle inlet opening.

JP02224629 to Osamu discloses a vacuum cleaner with a suction nozzle inlet configured to prevent power cord ingestion. A plurality of projections extend outwardly from the rear edge of the suction inlet towards the brush dowel. The distance between the brush dowel and the projections is configured to be less than the outer diameter of the power cord, thereby preventing ingestion of and damage to the power cord.

BRIEF DESCRIPTION OF THE INVENTION

According to the invention, a vacuum cleaner comprises a housing adapted to move along a surface to be cleaned and having a suction nozzle at a forward portion thereof, at least one agitator mounted for rotational movement within the suction nozzle and at least one ground-engaging wheel mounted rearwardly of the suction nozzle and a cord guard mounted to the housing in a position rearward of the suction nozzle and adapted to block the ingestion into the suction nozzle of a cord on the surface to be cleaned during rearward movement of the housing along the surface. The cord guard has a cord-receiving face comprising an arcuate portion terminating in an upwardly-extending leading edge portion that is adapted to block the cord when the cord receiving face is adjacent to the surface to be cleaned.

In one embodiment, the cord-receiving surface can have a radius of curvature generally corresponding to a radius of a power cord.

In another embodiment, the housing comprises a base and a handle, and the handle is pivotally mounted to the base. The cord guard can be configured to move between the retracted position and the extended position when the handle moves between a stored upright position and a reclining use position. The handle and the base can have interactive elements that move the cord guard between the retracted position and the extended positions when the handle moves between the stored upright position and the reclining use position. In addition, the interactive elements can be a cam and a cam follower.

In another embodiment, a vacuum cleaner comprises a housing adapted to move along a surface to be cleaned and has a suction nozzle at a forward portion thereof, at least one agitator mounted for rotational movement within the suction nozzle and at least one ground-engaging wheel mounted rearwardly of the suction nozzle and a cord guard mounted to the housing in a position rearward of the suction nozzle and adapted to block the ingestion into the suction nozzle of a cord on the surface to be cleaned during rearward movement of the housing along the surface and wherein the cord guard is mounted to the housing for selective movement between an extended position in which the cord guard is positioned adjacent to the surface to be cleaned and a retracted position in which the cord guard is spaced from the floor being cleaned and spaced from the extended position.

In still another embodiment, the cord guard can have a leading edge portion that is configured to guide a power cord on the surface up off the surface during rearward movement of the housing relative to the surface. The cord guard can be mounted to the housing for selective movement between an extended position in which the cord guard is positioned adjacent to the surface to be cleaned and a retracted position in which the cord guard is spaced from the surface. The vacuum cleaner can further comprise a second cord guard positioned forward of the at least one agitator to prevent a power cord from being ingested into the suction nozzle during forward movement of the vacuum cleaner relative to the surface.

In still another embodiment, a vacuum cleaner comprises a housing adapted to move along a surface to be cleaned and has a suction nozzle at a forward portion thereof, at least one agitator mounted for rotational movement within the suction nozzle and at least one ground-engaging wheel mounted rearwardly of the suction nozzle and a cord guard mounted to the housing in a position rearward of the suction nozzle and adapted to block the ingestion into the suction nozzle of a cord on the surface to be cleaned during rearward movement of the housing along the surface and wherein the cord guard can be positioned behind the at least one ground engaging wheel. The housing can have a rear wall adjacent to and spaced from the at least one ground engaging wheel, and the cord guard can have a leading edge portion projecting from the rear wall and configured to guide a power cord on the surface up the leading edge portion off the surface during rearward movement of the housing relative to the surface being cleaned.

In yet another embodiment, a vacuum cleaner comprises a housing adapted to move along a surface to be cleaned and has a suction nozzle at a forward portion thereof, at least one agitator mounted for rotational movement within the suction nozzle and at least one ground-engaging wheel mounted rearwardly of the suction nozzle, a cord guard mounted to the housing configured to block the ingestion into the suction nozzle of a cord on the surface to be cleaned during movement of the housing along the surface and. The second cord guard can have a leading edge portion thereon and is configured to contact a lower portion of a cord on the surface as the leading edge portion glides adjacent the surface during movement of the vacuum cleaner to guide a power cord on the surface up the leading edge portion off the surface during movement of the vacuum cleaner.

According to another embodiment, the cord guard can be positioned rearwardly of the suction nozzle to block the ingestion into the suction nozzle of a cord on the surface to be cleaned during rearward movement of the housing relative to the surface to be cleaned. In another embodiment, the cord guard can be positioned forwardly of the suction nozzle to block the ingestion into the suction nozzle of a cord on the surface to be cleaned during forward movement of the housing relative to the surface to be cleaned.

DESCRIPTION OF AN EMBODIMENT OF THE INVENTION

Figure 1:
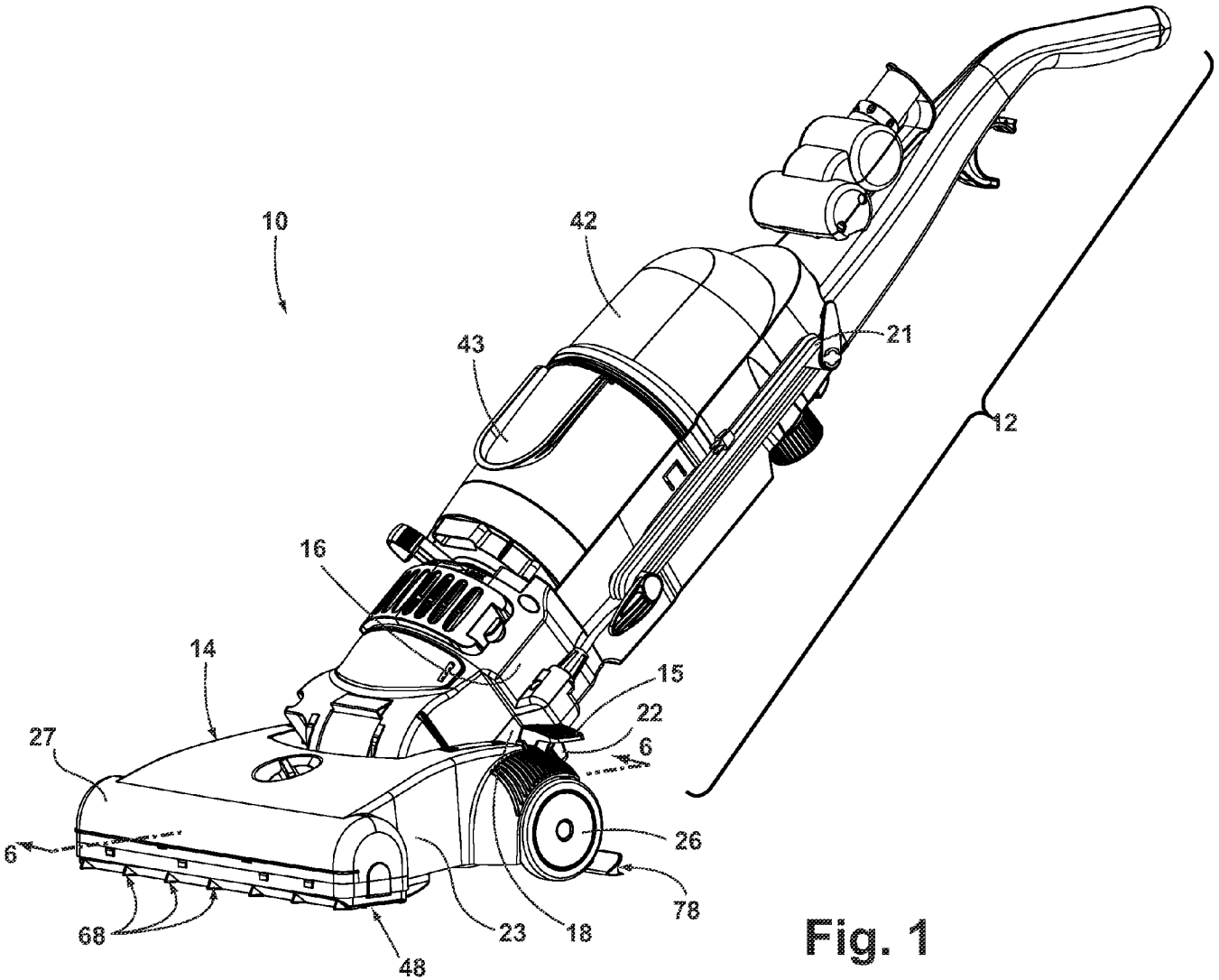
FIG. 1 is a front perspective view of an upright vacuum cleaner according to a first embodiment of the invention showing a handle assembly partially reclined and a rear cord guard in an extended or deployed position
Figure 2:
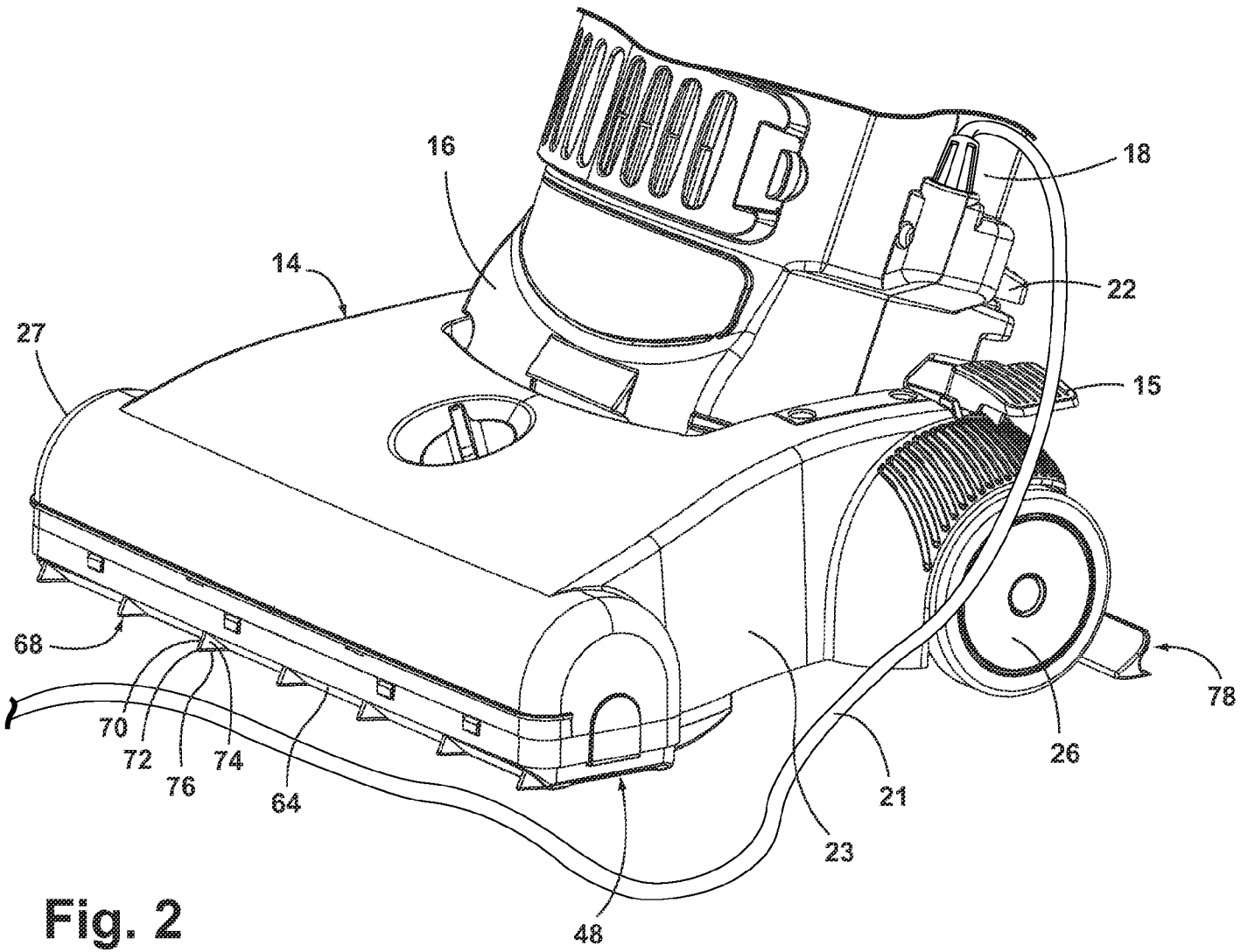
FIG. 2 is an enlarged front perspective view of the foot assembly of FIG. 1 according to the first embodiment of the invention.

Referring to the drawings, and in particular to FIGS. 1-4, a floor cleaner 10 in the form of an upright vacuum cleaner according to the invention can comprise an upright handle assembly 12 pivotally mounted to a base assembly 14 for directing the cleaner across the surface to be cleaned. The floor cleaner 10 can be any type of cleaner suitable for cleaning a floor or other surface such as an extractor, a sweeper and a vacuum cleaner. The cleaner 10 described herein shares many features of a traditional floor cleaner, which will not be described in detail except as necessary for a complete understanding of the invention.

The floor cleaner 10 can include a detent pedal 15 pivotally mounted to the base assembly 14 and can be configured to selectively engage and retain the upright handle 12 in an upright storage position. The handle 12 can recline to an operating position when the detent pedal 15 is depressed, as is commonly known in the art. The upright handle assembly 12 comprises a front and rear housing 16, 18 coupled together to form a chamber therebetween for housing a conventional motor/fan assembly (not shown). A power cord 21 can be connected to the motor/fan assembly via a power switch 22 for selectively energizing the cleaner 10 to perform a cleaning operation.

The base assembly 14 can comprise a housing 23 supported by a set of front and rear wheels 24, 26. An agitator housing 27 can be located in a front portion of the housing 23 defining an suction nozzle 28. The suction nozzle 28 can rotatably receive an agitator such as a conventional brushroll assembly 30 for agitating the surface to be cleaned. The suction nozzle 28 can be fluidly coupled with a working air flow system comprising the motor/fan assembly for extracting debris from the surface, as is commonly known in the vacuum cleaner art. The motor/fan assembly can generate a working air flow to draw debris from the surface adjacent the suction nozzle 28 and through the suction nozzle to a separator 42 for separating the debris from the working air flow where the debris can be deposited in a dirt cup 43 that is selectively mounted beneath the separator 42. The separator 42 can also be coupled to the motor/fan assembly through an exhaust conduit (not shown) for exhausting the working air flow.

Figure 3:
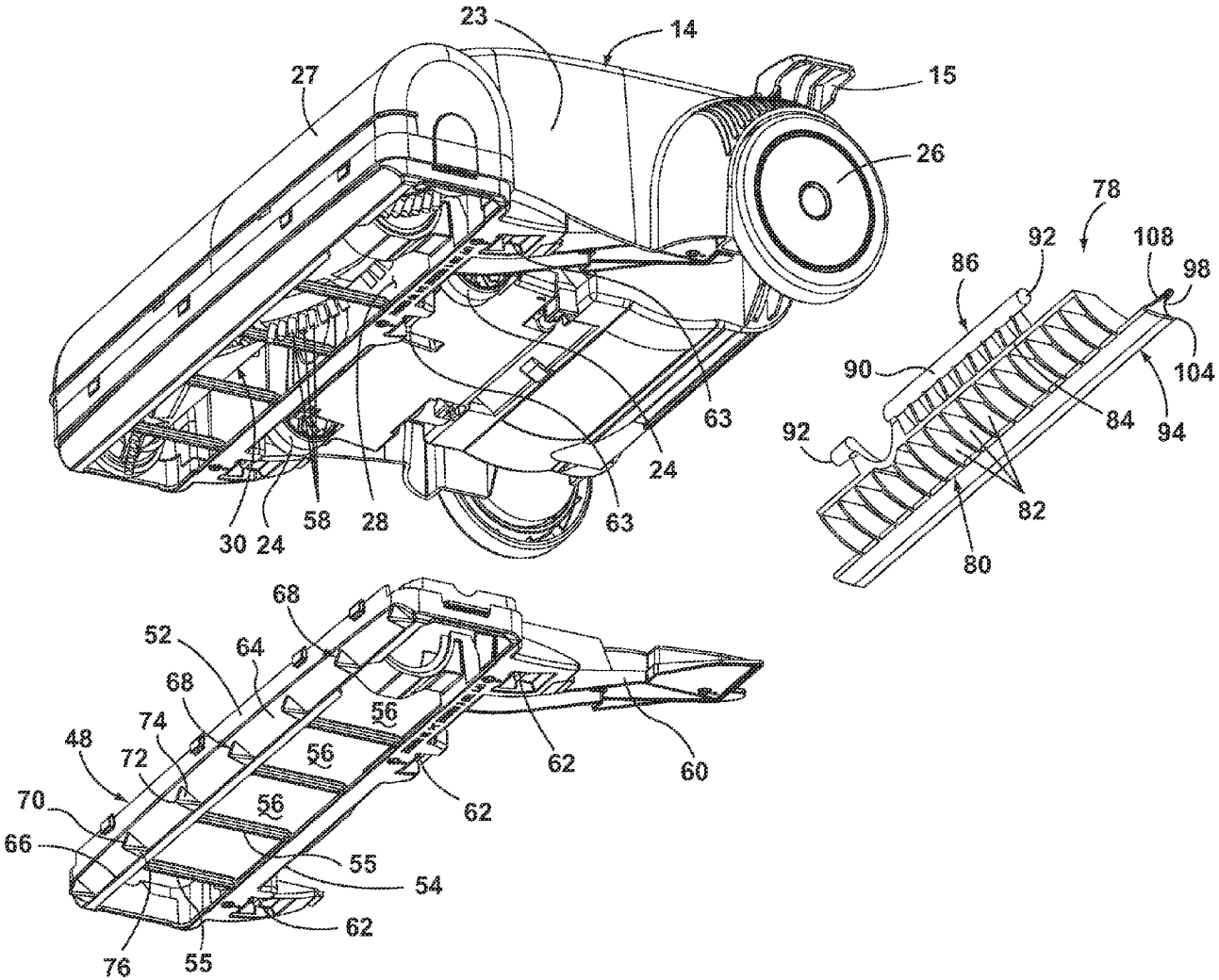
FIG. 3 is a partial exploded view of the foot assembly of FIG. 1 according to the first embodiment of the invention.
Figure 4:
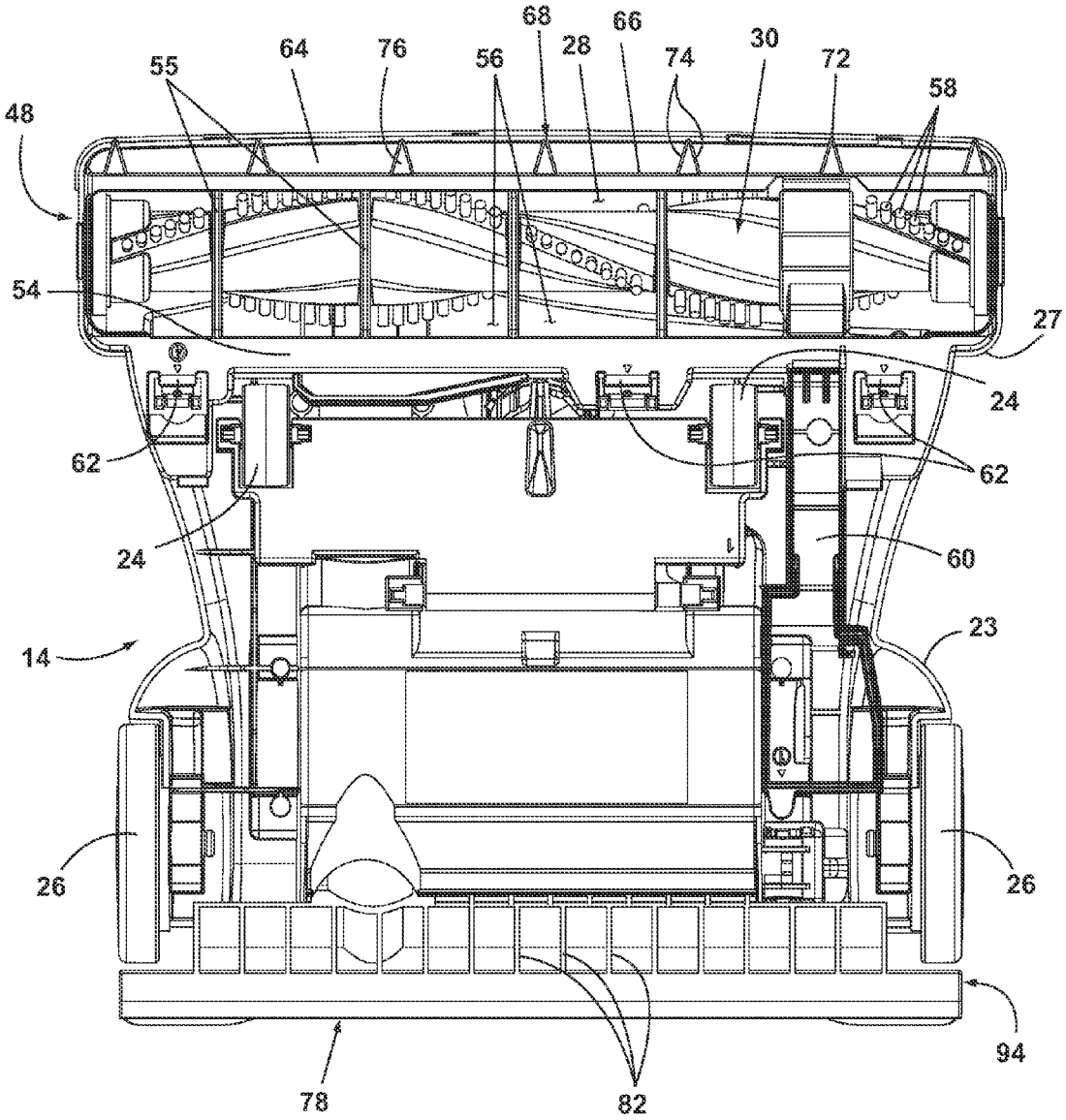
FIG. 4 is a bottom view of the foot assembly of FIG. 1 according to the first embodiment of the invention.

Referring now to FIGS. 3 and 4, a sole plate 48 can be mounted to the agitator housing 27 and can have a generally rectangular shape and have a pair of front and rear walls 52, 54. A plurality of ribs 55 can extend between the front and rear walls 52, 54, defining a plurality of open areas 56 through which brushroll tufts 58 can protrude when the sole plate 48 is mounted to the agitator housing 27. The sole plate 48 can further comprise a belt cover 60 that extends rearwardly from the rear wall 54 to shield the drive belt (not shown) that connects the brushroll 30 to a drive motor shaft (not shown). A pair of resilient mounting clips 62 can extend from the rear wall 54 of the sole plate 48 for selective connection to corresponding mounting recesses 63 in the base assembly 14. Alternatively, other mechanical fasteners can be used to secure the sole plate 48 to the base assembly 14.

The front wall 52 can include a chamfered portion 64 extending from an upper portion of the front wall 52 downward to a horizontal bottom surface 66 adjacent to the cleaning surface. A plurality of incrementally spaced wedges 68 can extend outwardly from the chamfered portion 64 of the sole plate 48. Each wedge 68 can comprise a generally vertical front edge 70 extending at an angle from a protruding tip 72 of the wedge 68 away from the surface to be cleaned. A pair of sidewalls 74 can project at an angle away from front edge 70 towards the front wall 52. The wedge 68 can also include a bottom wall 76 defined by the sidewalls 74 and the front wall 52 that is co-planar with the bottom wall surface 66 of the sole plate 48.

Figure 5:
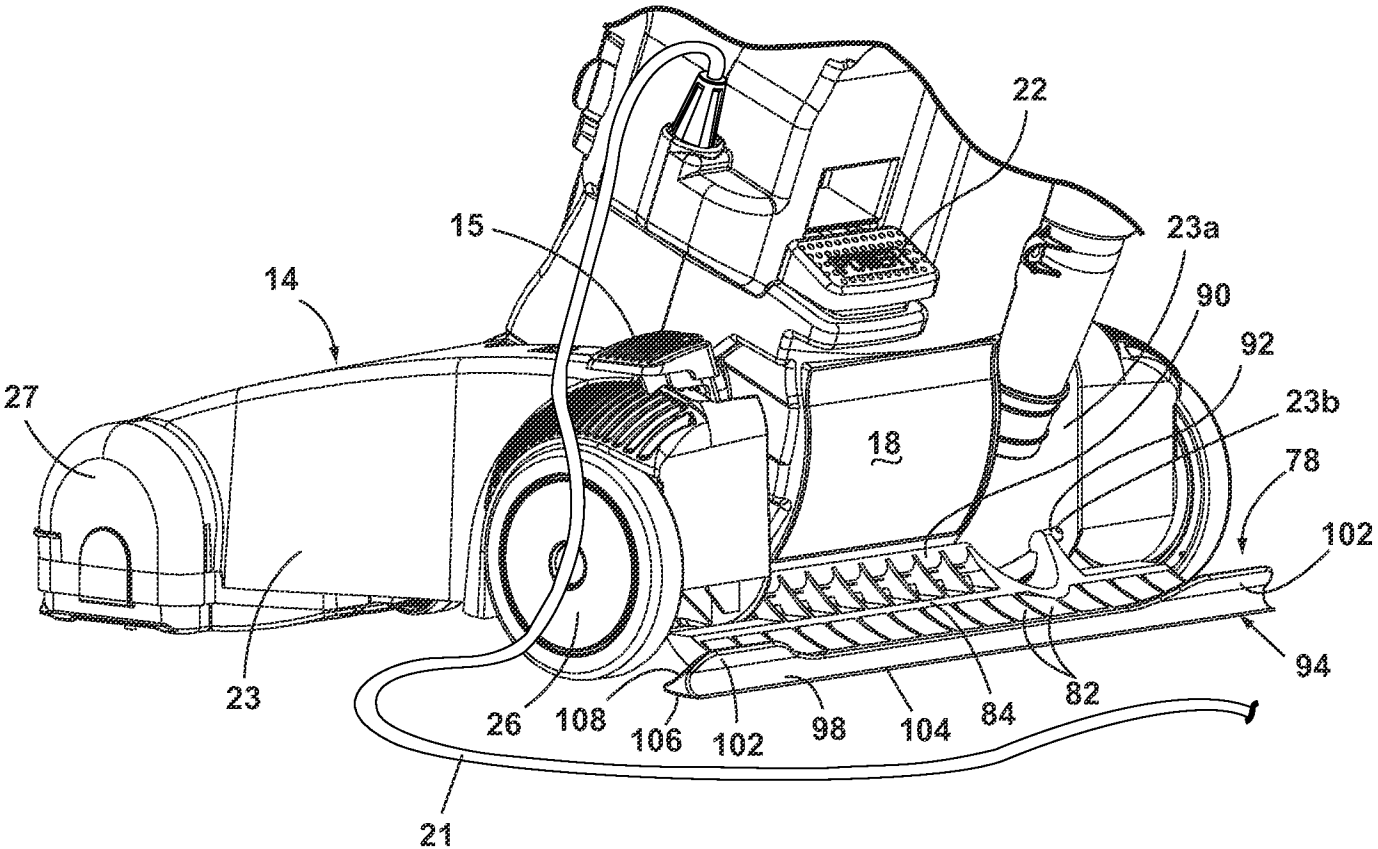
FIG. 5 is an enlarged rear perspective view of the foot assembly of FIG. 1 according to the first embodiment of the invention.

Referring now to FIGS. 3-5, the cleaner 10 can include a rear cord guard 78 comprising an arcuate structural framework 80 having a plurality of spaced, generally vertical ribs 82 having a transverse central stiffening rib 84 that spans the width of the framework 80 and rigidly connects each of the arcuate ribs 82. A pivot assembly 86 is joined to the stiffening rib 84 and comprises a pivot rod 90 having at each end exposed bearing pins 92 that are configured to be rotatably received within corresponding bearing holes **23*b* in vertical rear walls 23*a* (FIG. 5) of the base housing 23 for pivotally mounting the rear cord guard 78 therein. The pivot assembly 86 can comprise an interrupted pivot rod 90 having multiple segments, as illustrated in FIGS. 3 and 5** or an uninterrupted pivoted rod (not shown).

The rear cord guard 78 can also comprise a transverse proximal stiffening rib in the form of a guard blade 94, located at a proximal end of the framework 80 opposite the pivot assembly 86. The guard blade 94 can comprise a first face 98 that can be concave with a curvature radius of ⅛ inch, for example, and can be coupled with the vertical ribs 82 on a second face opposite the first face 98. The curvature radius of the first face 98 can be selected according to the outer diameter of the power cord 21. Depending on the cordset characteristics, the curvature radius will typically range between ⅛-¾ inches, however, it is within the scope of the invention for the curvature radius to have any suitable dimension, or a straight wall having no radius. The first face 98 of the guard blade 94 can provide a cord-receiving surface for the rear cord guard 78 for receiving the power cord 21 during movement of the vacuum cleaner 10.

The guard blade 94 can further include an extended wall 102 that projects tangentially from the top of the first face 98 to enhance cord guidance and prevent the power cord 21 from rolling over the top of the blade 94. The bottom of the first face 98 can taper outwardly into a thin guard blade edge 104 that can be closely adjacent to or in contact with the surface to be cleaned. A bottom 106 of the rear cord guard 78 can be curved slightly to facilitate gliding across the cleaning surface during use. Alternatively, small rollers (not shown) can be mounted at the ends of the guard blade 94 and configured to protrude slightly below the bottom 106 for rolling across the cleaning surface. A second face 108 of the guard blade 94, opposite the first face 98, can comprise a radius of curvature in the range of 1 to 3 inches and is preferably about 1.85 inches. The second face 108 can be configured to have any suitable radius of curvature to clear the rear wheels 26 when the rear cord guard 78 is in an upright, retracted position.

Figure 6:
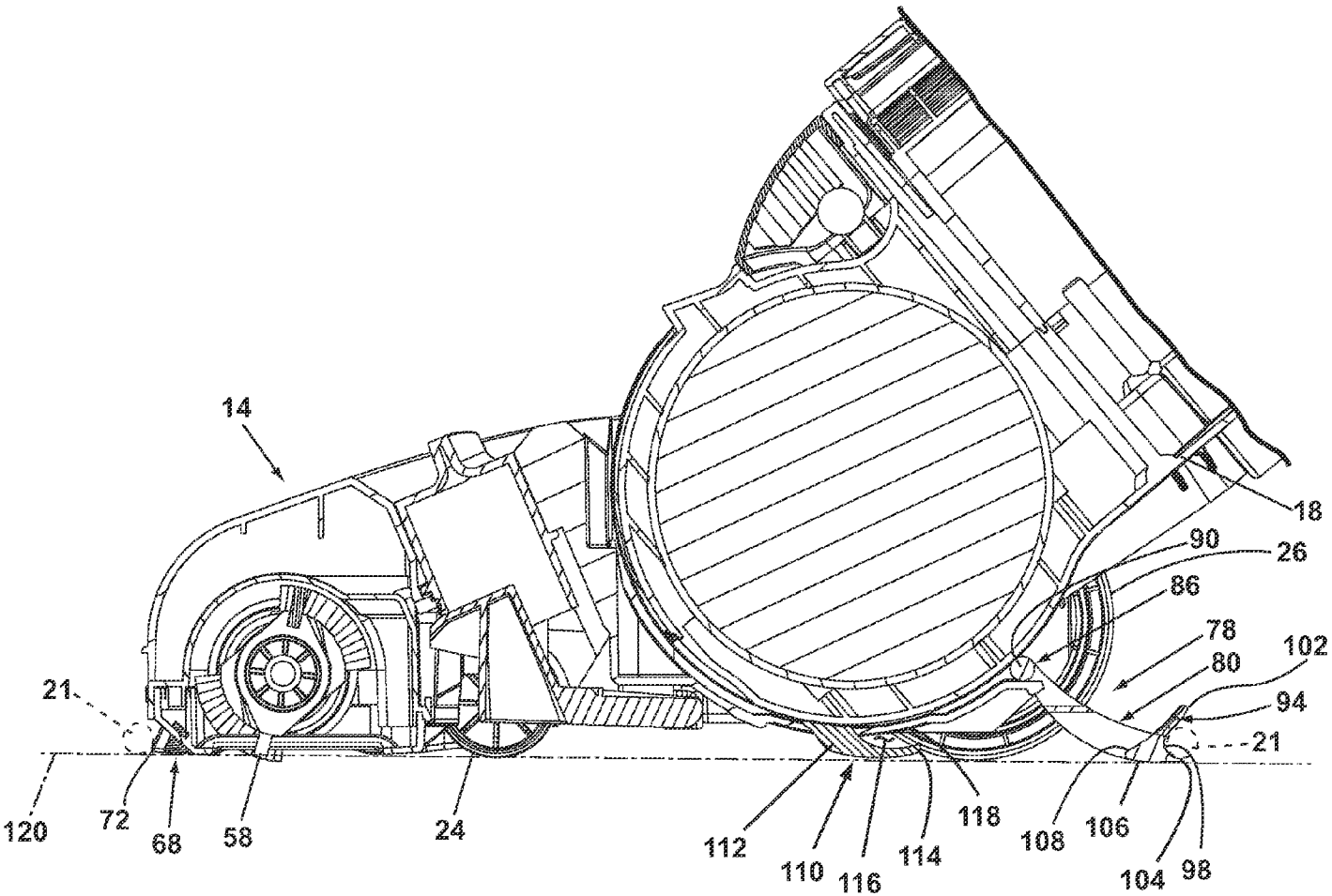
FIG. 6 is a cross-sectional view of the foot assembly of FIG. 5 taken along line 6-6 of FIG. 1.
Figure 7:
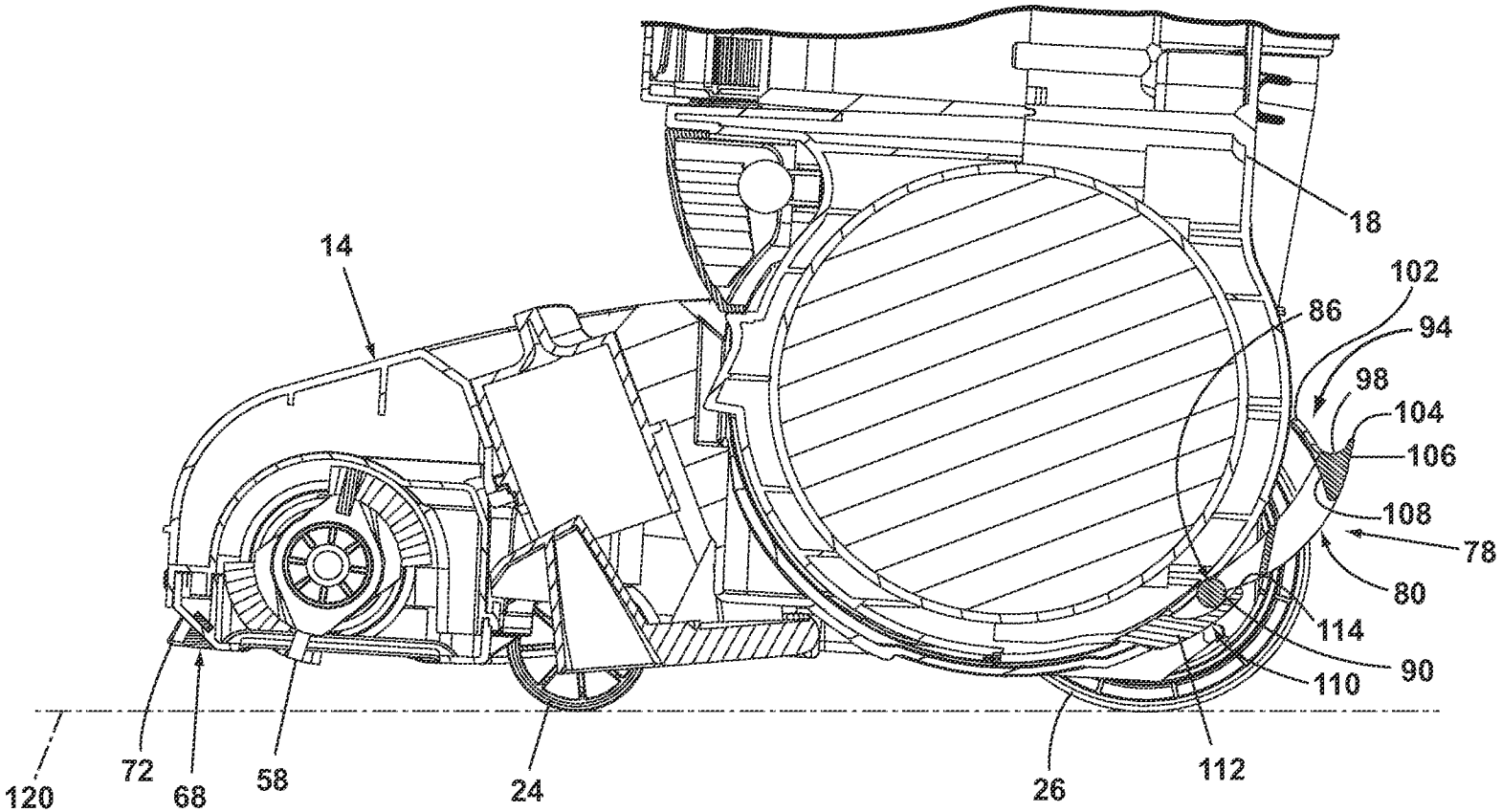
FIG. 7 is a partial cross-sectional view of the foot assembly of FIG. 1 like FIG. 6 but with the handle assembly in an upright position and the cord guard in a retracted position.

The rear cord guard 78 can be mounted and configured for movement between an extended position closely adjacent to or in contact with a cleaning surface 120 when the upright handle 12 is reclined to its operating position as illustrated in FIGS. 1-6 and to a retracted position when the upright handle 12 is returned to its upright storage position as illustrated in FIG. 7. The handle and the base can have interactive elements that move the cord guard between the retracted position and the extended positions when the handle moves between the stored upright position and the reclining use position. For example, the interactive elements can be a cam and a cam follower.

As shown in FIGS. 6-7, a cam 110 can protrude rearwardly from a lower portion of the rear housing 18 of the handle assembly 12. The cam 110 can comprise a first end 112 that can be coupled with the rear housing 18 and a second end 114 that is spaced from the rear housing 18. A guide slot 116 is formed between the cam 110 and the rear housing 18 and comprises an open end 118 between the second end 114 of the cam 110 and the rear housing 18. The cam 110 is configured to selectively engage the rear cord guard 78 depending on the rotational position of the upright handle 12. The guide slot 116 is configured to receive the pivot rod 90 of the pivot assembly 86 and the framework 80 to lift the rear cord guard 78 upwardly into its retracted position when the upright handle 12 is returned to its upright position. Conversely, the guide slot 116 is configured to disengage the pivot rod 90 and framework 80 of the rear cord guard 78, which results in the cord guard 78 pivoting downward about the pivot rod 90 such that the rear cord guard 78 can engage the cleaning surface 120 when the upright handle 12 is reclined during operation. An optional biasing member, such as a conventional torsion spring (not shown), can be coupled with the pivot assembly 86 and configured to bias the guard blade 94 downwardly against the cleaning surface 120 while in the engaged position.

Figure 8:
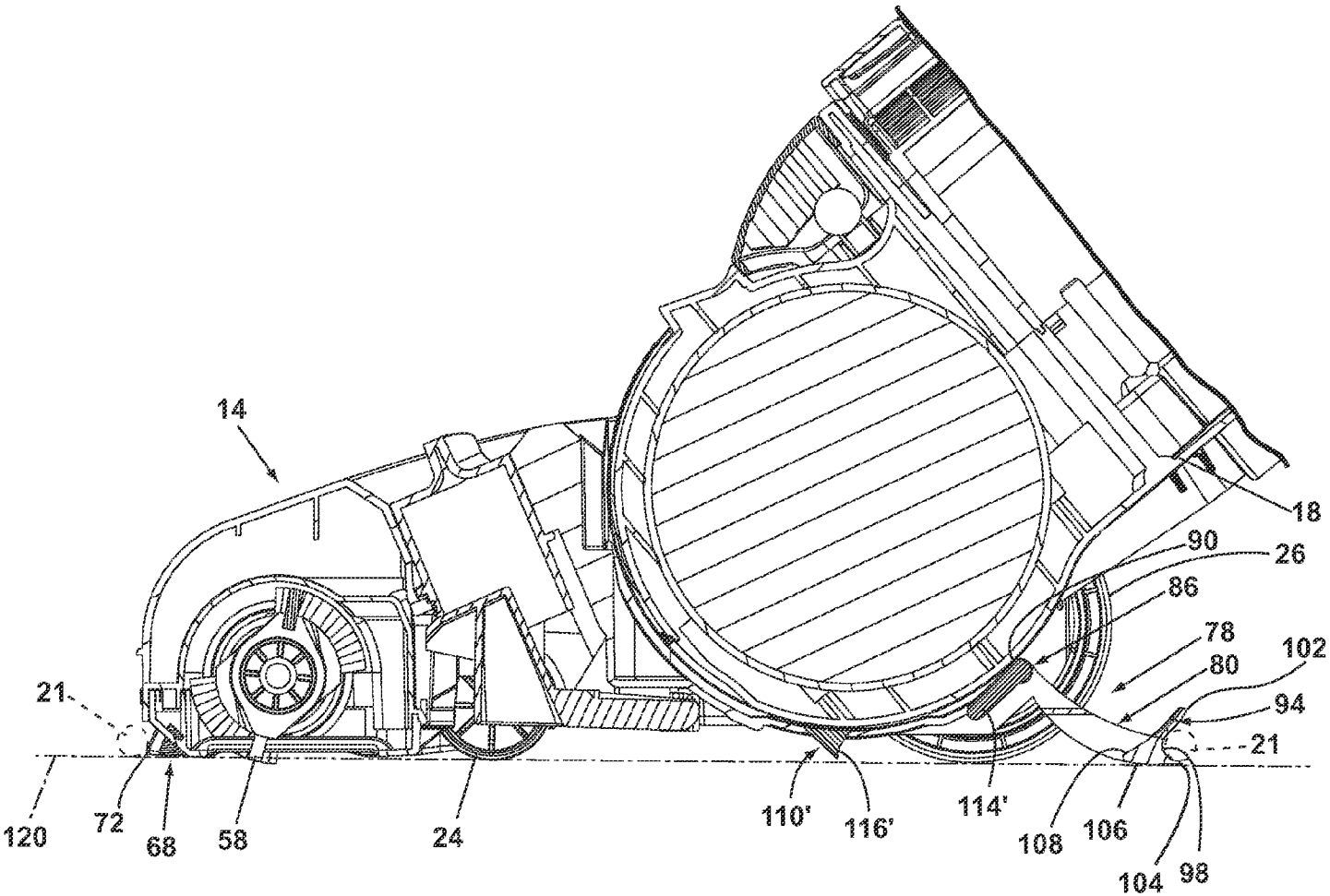
FIG. 8 is a partial cross-sectional view of a foot assembly like FIG. 6 with the handle assembly partially reclined and illustrating a second embodiment of the invention.
Figure 9:
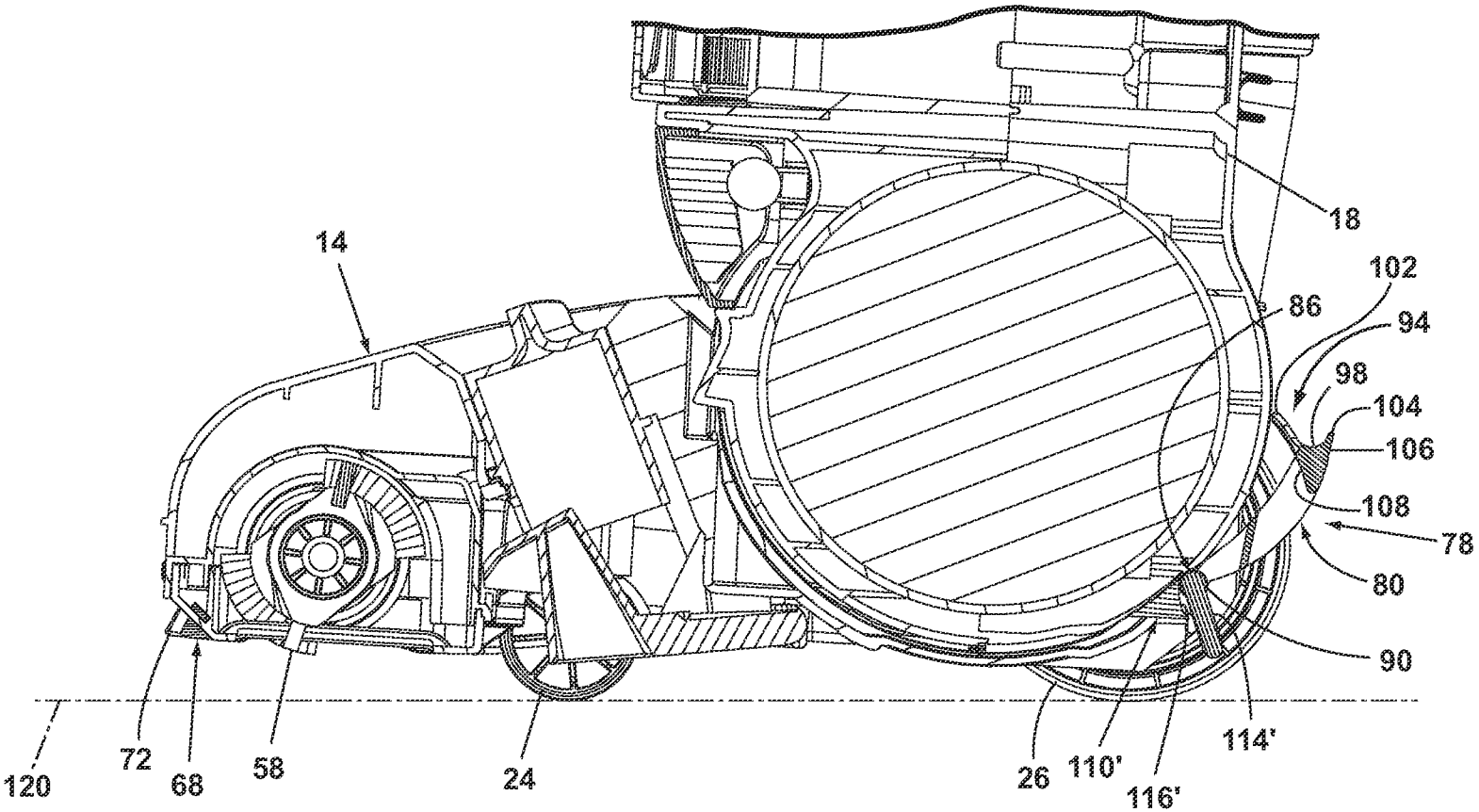
FIG. 9 is a partial cross-sectional view of the foot assembly of FIG. 8 with the upright handle is in an upright storage position and the cord guard in a retracted position.

FIGS. 8 and 9 illustrate an alternative cam 110' that can be used to with the cleaner 10 to move the rear cord guard 78 between its engaged position and its retracted position in a manner similar to the cam 110. The cam 110' can be in the form of a ramp protruding from the lower portion of the rear housing 18. The pivot assembly 86 can include a follower arm 114' protruding outwardly from the pivot rod 90 that can be configured to slide along an engaging surface 116' of the cam 110' and pivot downwardly to lift the guard blade 94 off the cleaning surface when the upright handle 12 is returned to its upright storage position. Conversely, when the upright handle 12 is reclined into its operating position, the follower arm 114' can slide along the engaging surface 116' until becoming disengaged from the cam 110', thereby releasing the rear cord guard 78 to rotate downward about the pivot rod 90 to meet the cleaning surface.

While the rear cord guard 78 is illustrated as being located behind the rear wheel 24, it is within the scope of the invention for the rear cord guard 78 to be located anywhere on either the handle assembly 12 or the base assembly 14 rearward of the brushroll assembly 30. For example, the rear cord guard 78 can be mounted to the base assembly 14 immediately rearward of the suction nozzle 28. Alternatively, the rear cord guard 78 can be mounted to the base assembly 14 between the suction nozzle 28 and the rear wheel 24.

A method of operation of the cleaner 10 will now be described. While the method is described in the context of a cleaner 10 having the cam 110, the method can be used in a similar manner with a cleaner 10 having the cam 110'. In operation, a user can prepare the vacuum cleaner 10 for use by connecting the power cord 21 to a power outlet and then actuating the power switch 22 to energize the cleaner 10 to perform a cleaning operation. Next, the user can depress the detent pedal 15 to recline the upright handle 12 into an operating position. As the upright handle is 12 reclined, the cam 110 can rotate forward and the pivot rod 90 and the framework 80 of the rear cord guard 78 can slide within the guide slot 116 and eventually exit the open end 118 of the guide slot 116 to disengage the cam 110. As the cam 110 disengages the rear cord guard 78, the rear guard cord 78 can rotate about the bearing pins 92 protruding from the pivot rod 90 that are rotatably received within bearing holes **23*b* in the rear wall 23*a* so that the proximal end 96 of the framework 80 supporting the guard blade 94 can rotate downwardly toward the surface to be cleaned. Rotation of the guard blade 94 can bring the blade edge 104 and bottom 106 of the rear cord guard 78 into engagement with a cleaning surface 120**.

As the vacuum cleaner 10 is maneuvered back and forth across a cleaning surface, the power cord 21 can be brought into the cleaning path of the cleaner 10. When the power cord 21 obstructs the forward cleaning path in front of the suction nozzle 28 during a forward push stroke, the cord blocking wedges 68 can engage the power cord 21 and prevent the power cord 21 from entering the suction nozzle 28 and contacting the brushroll 30 or being wrapped around the brushroll 30. Preventing the power cord 21 from interacting with the brushroll 30 while the brushroll 30 is activated can prevent abrasion and damage to the power cord 21. The protruding tip 72 of each cord blocking wedge 68 glides adjacent to the cleaning surface and is configured to contact a lower portion of the power cord 21 resting on the cleaning surface. As the vacuum cleaner 10 is pushed forward, the power cord 21 can ride upwardly along the angled front edge 70 of cord blocking wedge 68, thereby lifting it from the cleaning surface and preventing the power cord 21 from entering the suction nozzle 28.

The rear cord guard 78 prevents the power cord 21 from entering the suction nozzle 28 and contacting the brushroll 30 when the power cord 21 obstructs the rearward cleaning path behind the rear wheels 26 during a rearward pull stroke, thereby preventing abrasion and damage to the power cord 21. As the cleaner 10 is pulled rearward, the cord guard blade 94 can engage the cleaning surface and the blade edge 104 can engage a lower portion of the power cord 21 resting on the cleaning surface and scoop the power cord 21 into the first face 98 of the guard blade 94. The extended wall 102 can prevent the power cord 21 from rolling out of the first face 98 over the top of the guard blade 94.

Upon completion of the cleaning task, a user can return the upright handle 12 to its upright storage position. As the handle 12 is rotated upwardly, the cam 110 can rotate rearwardly and the guide slot 116 can engage the pivot rod 90 and framework 80 of the rear cord guard 78. The pivot rod 90 and framework 80 can slide within the guide slot 116 until coming into contact with the second end 112 of the cam 110. As the cam 110 engages the rear cord guard 78, the rear cord guard 78 can rotate about the bearing pins 92, lifting the guard blade 94 away from the cleaning surface into the retracted storage position. While in the storage position, the second face 108 of the rear cord guard 78 is spaced from the rear wheels 26 and rear handle housing 18 to provide clearance between the rear cord guard 78 and the rear wheels 26 and rear handle housing 18.

Figure 10:
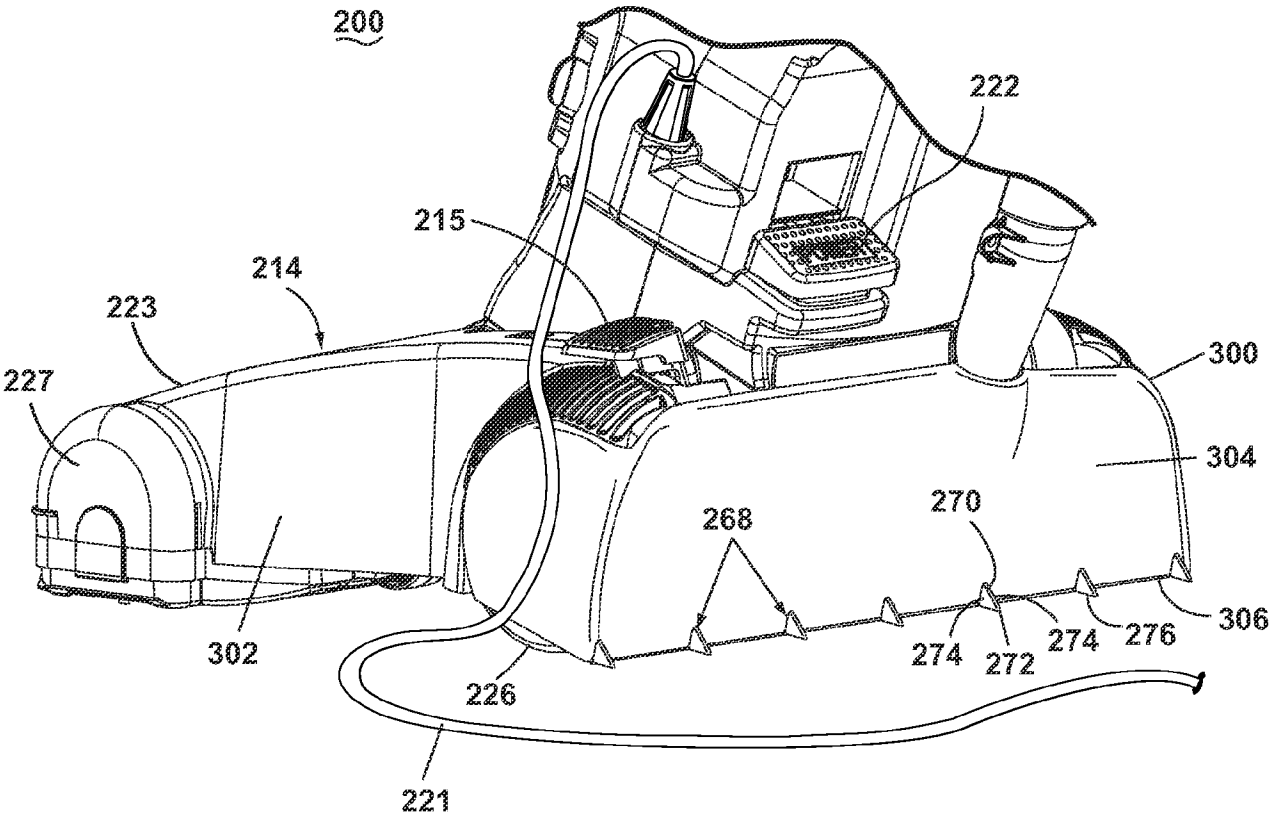
FIG. 10 is a partial rear perspective view of a foot assembly according to a third embodiment of the invention.

FIG. 10 illustrates another embodiment of the invention comprising a cleaner 200, which is similar to the cleaner 10, except for the shape of a base assembly 214. Therefore, elements in the cleaner 200 similar to those of cleaner 10 will be numbered with the prefix 200, with it being understood that the description of the like parts of the cleaner 10 according to the first embodiment applies to the cleaner 200, unless otherwise noted.

As illustrated in FIG. 10, the cleaner 200 can comprise a base assembly 214 having a housing 223. The housing 223 can comprise an agitator housing 227 at a front portion thereof and a rear wheel housing 300 at a rear portion thereof. The rear wheel housing 300 can be formed by a pair of side walls 302 of the housing 223 extending from the agitator housing 227 to a rear wall 304, past a pair of rear wheels 226. The rear wall 304 can have a bottom wall 306 adjacent the surface to be cleaned.

The cleaner 200 can also comprise a plurality of incrementally spaced wedges 268 extending outwardly from a lower portion of the rear wall 304. The wedges 268 are similar to the wedges 68 described above in the context of the cleaner 10. Each wedge 268 can comprise a generally vertical front edge 270 extending at an angle from a protruding tip 272 of the wedge 268 away from the surface to be cleaned. A pair of sidewalls 274 can project at an angle away from front edge 270 towards the rear wall 304. The wedge 268 can also include a bottom wall 276 defined by the sidewalls 274 and the rear wall 304 that is generally co-planar with the bottom wall 306 of the rear wheel housing 300.

The rear wheel housing 300 comprising the wedges 268 along the rear wall 304 can be used as an alternative to the cord guard 78 of the previous embodiment of the invention illustrated in FIGS. 1-5 to prevent a power cord 221 from engaging an agitator located within the agitator housing 227. As the vacuum cleaner 200 is maneuvered back and forth across a surface to be cleaned, the power cord 221 can be brought into the cleaning path of the cleaner 200. When the power cord 221 intersects the rearward cleaning path behind the rear wheels 226 during a rearward pull stroke, the wedges 268 projecting from the rear wheel housing 300 can engage the power cord 221 and prevent the power cord 221 from engaging the agitator located within in the agitator housing 227 in a manner similar to that described above with respect to the cord guard 78 illustrated in FIG. 6.

Figure 11:
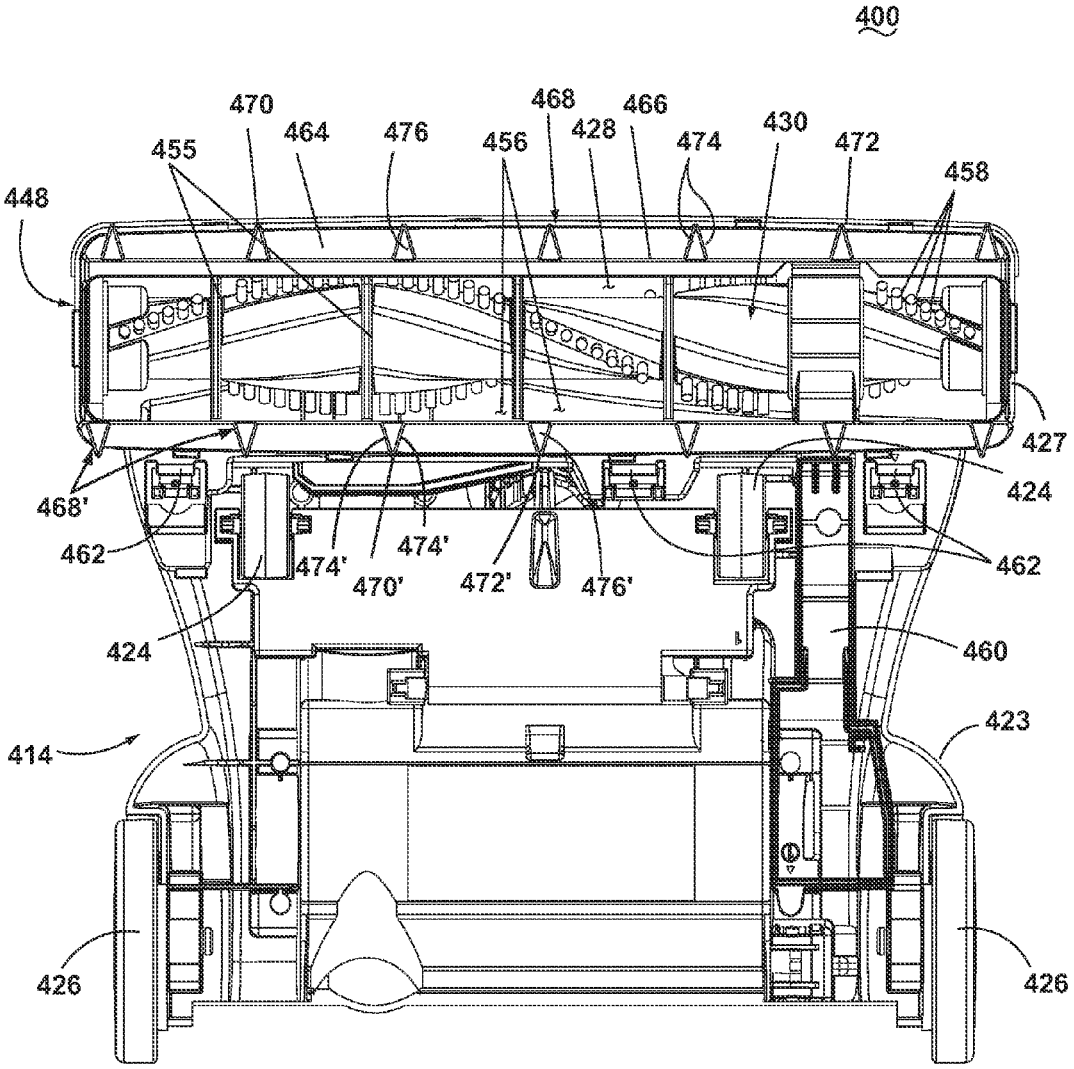
FIG. 11 is a bottom view of a foot assembly according to a fourth embodiment of the invention.

Referring now to FIG. 11, another embodiment of the invention comprising a cleaner 400 is illustrated, which is similar to the cleaner 10, except for the shape of a sole plate 448. Therefore, elements in the cleaner 400 similar to those of cleaner 10 will be numbered with the prefix 400, with it being understood that the description of the like parts of the cleaner 10 according to the first embodiment applies to the cleaner 400, unless otherwise noted.

As illustrated in FIG. 11, the cleaner 400 can have a base assembly 414 having a housing 423 comprising an agitator housing 427 at a front portion thereof defining a suction nozzle 428. The suction nozzle 428 can rotatably receive an agitator such as a conventional brushroll assembly 430 for agitating the surface to be cleaned. A sole plate 448 can be mounted to the agitator housing 427 and can have a generally rectangular shape and a pair of front and rear walls 452, 454. A plurality of ribs 455 can extend between the front and rear walls 452, 454, defining a plurality of open areas 456 through which brushroll tufts 458 can protrude when the sole plate 448 is mounted to the agitator housing 427.

The sole plate 448 can further comprise a belt cover 460 that extends rearwardly from the rear wall 454 to shield the drive belt (not shown) that connects the brushroll 430 to the drive motor shaft (not shown). A pair of resilient mounting clips 462 can extend from the rear wall 454 of the sole plate 448 for selective connection to corresponding mounting recesses 463 in the base assembly 414. Alternatively, mechanical fasteners can be used to secure the sole plate 448 to the base assembly 414.

The front wall 452 can include a chamfered portion 464 extending from an upper portion of the front wall 452 downward to a horizontal bottom surface 466 adjacent to the cleaning surface. A plurality of incrementally spaced wedges 468 can extend outwardly from the chamfered portion 464 of the sole plate 448, in manner similar to that described above in the context of the cleaner 10 as illustrated in FIGS. 1-4. In addition, a plurality of incrementally spaced wedges 468' can extend outwardly from the rear wall 454 of the sole plate 448.

The wedges 468 and 468' are similar to the wedges 68 described above with reference to FIGS. 2-4. Each wedge 468 and 468' can comprise a generally vertical front edge 470, 470' extending at an angle from a protruding tip 472, 472' of the wedge 468, 468', respectively, away from the surface to be cleaned. Each wedge 468 can have a pair of sidewalls 474 projecting at an angle away from the front edge 470 towards the front wall 452. Similarly, each wedge 468' can have a pair of sidewalls 474' projecting at an angle away from front edge 470' towards the rear wall 454. The wedges 468, 468' can also include a bottom wall 476, 476' defined by the sidewalls 474 and the front wall 452 and the sidewalls 474' and rear wall 454, respectively, that is co-planar with the bottom wall surface 466 of the sole plate 448.

Similar to as described above with respect to FIGS. 6 and 7, the wedges 468 are configured to prevent a power cord (not shown) on the surface to be cleaned and intersecting the cleaning path of the cleaner 400 from entering the section nozzle 428 and contacting the brushroll 430 on a forward stroke of the cleaner 400. In a similar manner, the wedges 468' are configured to prevent a power cord on the surface to be cleaned and intersecting the cleaning path of the cleaner 400 from entering the section nozzle 428 and contacting the brushroll 430 on a rearward stroke of the cleaner 400.

The sole plate 448 can be used with any of the embodiments of the invention described herein for preventing a power cord of a cleaner from engaging an agitator of the cleaner on both a forward and rear stroke of the cleaner.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A vacuum cleaner comprising:

a housing adapted to move along a surface to be cleaned and having a suction nozzle at a forward portion thereof, at least one agitator mounted for rotational movement within the suction nozzle and at least one ground-engaging wheel mounted rearwardly of the suction nozzle; and a cord guard mounted to the housing in a position rearward of the suction nozzle and adapted to block the ingestion into the suction nozzle of a cord on the surface to be cleaned during rearward movement of the housing along the surface;

wherein the cord guard has a cord-receiving face comprising an arcuate portion terminating in an upwardly-extending leading edge portion that is adapted to block the cord when the cord-receiving face is adjacent to the surface to be cleaned.

2. The vacuum cleaner of claim 1 wherein the cord-receiving face has a radius of curvature generally corresponding to a radius of a power cord.

3. The vacuum cleaner of claim 1 wherein the cord guard is mounted to the housing for selective movement between an extended position in which the cord guard is positioned adjacent to the surface to be cleaned and a retracted position in which the cord guard is spaced from the surface to be cleaned.

4. The vacuum cleaner of claim 1 wherein the cord guard has a leading edge portion that is configured to guide a power cord on the surface up off the surface during rearward movement of the housing relative to the surface.

5. The vacuum cleaner of claim 1 and further comprising a second cord guard positioned forward of the at least one agitator to prevent a power cord from being ingested into the suction nozzle during forward movement of the vacuum cleaner relative to the surface.

6. A vacuum cleaner comprising:

a housing adapted to move along a surface to be cleaned and having a suction nozzle at a forward portion thereof, at least one agitator mounted for rotational movement within the suction nozzle and at least one ground-engaging wheel mounted rearwardly of the suction nozzle; and a cord guard mounted to the housing in a position rearward of the suction nozzle and adapted to block the ingestion into the suction nozzle of a cord on the surface to be cleaned during rearward movement of the housing along the surface;

wherein the cord guard is mounted to the housing for selective movement between an extended position in which the cord guard is positioned adjacent to the surface to be cleaned and a retracted position in which the cord guard is spaced from the surface being cleaned.

7. The vacuum cleaner of claim 6 wherein the housing comprises a base and a handle, and the handle is pivotally mounted to the base, and the cord guard is configured to move between the retracted position and the extended position when the handle moves between a stored upright position and a reclining use position.

8. The vacuum cleaner of claim 7 wherein the handle and the base have interactive elements that move the cord guard between the retracted position and the extended positions when the handle moves between the stored upright position and the reclining use position.

9. The vacuum cleaner of claim 8 wherein the interactive elements comprise a cam and a cam follower.

10. The vacuum cleaner of claim 6 wherein the cord guard has a leading edge portion that is configured to guide a power cord on the surface up off the surface during rearward movement of the housing relative to the surface.

11. The vacuum cleaner of claim 6 and further comprising a second cord guard positioned forward of the at least one agitator to prevent a power cord from being ingested into the suction nozzle during forward movement of the vacuum cleaner relative to the surface.

12. A vacuum cleaner comprising:

a housing adapted to move along a surface to be cleaned and having a suction nozzle at a forward portion thereof, at least one agitator mounted for rotational movement within the suction nozzle and at least one ground-engaging wheel mounted rearwardly of the suction nozzle; and a cord guard mounted to the housing in a position rearward of the suction nozzle and adapted to block the ingestion into the suction nozzle of a cord on the surface to be cleaned during rearward movement of the housing along the surface;

wherein the cord guard is positioned behind the at least one ground-engaging wheel.

13. The vacuum cleaner of claim 12 wherein the housing comprises a rear wall adjacent to and spaced from the at least one ground-engaging wheel, and wherein the cord guard has a leading edge portion projecting from the rear wall and configured to guide a power cord on the surface up the leading edge portion off the surface during rearward movement of the housing relative to the surface being cleaned.

14. The vacuum cleaner of claim 12 and further comprising a second cord guard positioned forward of the at least one agitator to prevent a power cord from being ingested into the suction nozzle during forward movement of the vacuum cleaner relative to the surface.

15. The vacuum cleaner of claim 12 wherein the cord guard has a leading edge portion that is configured to guide a power cord on the surface up off the surface during rearward movement of the housing relative to the surface.

16. The vacuum cleaner of claim 12 wherein the cord guard is mounted to the housing for selective movement between an extended position in which the cord guard is positioned adjacent to the surface to be cleaned and a retracted position in which the cord guard is spaced from the surface being cleaned.

17. A vacuum cleaner comprising:

a housing adapted to move along a surface to be cleaned and having a suction nozzle at a forward portion thereof, at least one agitator mounted for rotational movement within the suction nozzle and at least one ground-engaging wheel mounted rearwardly of the suction nozzle; and a cord guard mounted to the housing configured to block the ingestion into the suction nozzle of a cord on the surface to be cleaned during movement of the housing along the surface;

wherein the cord guard has a leading edge portion thereon and is configured to contact a lower portion of a cord on the surface as the leading edge portion glides adjacent the surface during movement of the vacuum cleaner and guide the cord up the leading edge portion off the surface.

18. The vacuum cleaner of claim 17 wherein the cord guard is positioned rearwardly of the suction nozzle to block the ingestion into the suction nozzle of a cord on the surface to be cleaned during rearward movement of the housing relative to the surface to be cleaned.

19. The vacuum cleaner of claim 17 wherein the cord guard is positioned forwardly of the suction nozzle to block the ingestion into the suction nozzle of a cord on the surface to be cleaned during forward movement of the housing relative to the surface to be cleaned.

* * * * *